US012312868B2

(12) United States Patent
Brooks

(10) Patent No.: US 12,312,868 B2
(45) Date of Patent: May 27, 2025

(54) DRILL BIT FOR BORING EARTH AND OTHER HARD MATERIALS

(71) Applicants: Ulterra Drilling Technologies, L.P., Fort Worth, TX (US); Nathan Andrew Brooks, Slade Point (AU)

(72) Inventor: Nathan Andrew Brooks, Slade Point (AU)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 0 days.

(21) Appl. No.: 17/296,869

(22) PCT Filed: Nov. 26, 2019

(86) PCT No.: PCT/AU2019/051292

§ 371 (c)(1),
(2) Date: May 25, 2021

(87) PCT Pub. No.: WO2020/107063

PCT Pub. Date: Jun. 4, 2020

(65) Prior Publication Data

US 2022/0025712 A1 Jan. 27, 2022

(30) Foreign Application Priority Data

Nov. 26, 2018 (AU) ..... 2018904497

(51) Int. Cl.
*E21B 10/62* (2006.01)
*E21B 10/42* (2006.01)
(Continued)

(52) U.S. Cl.
CPC ..... *E21B 10/62* (2013.01); *E21B 10/42* (2013.01); *E21B 10/50* (2013.01); *E21B 10/52* (2013.01); *E21B 10/58* (2013.01); *E21B 10/633* (2013.01)

(58) Field of Classification Search
CPC ..... E21B 10/62; E21B 10/42; E21B 10/43; E21B 10/52; E21B 10/58; E21B 10/633;
(Continued)

(56) References Cited

U.S. PATENT DOCUMENTS 2,085,941 A * 7/1937 Arnold ..... E21B 10/18 175/417
2,893,714 A * 7/1959 Proctor ..... E21C 35/1933 299/109

(Continued)

FOREIGN PATENT DOCUMENTS

| | | | |
|---|---|---|---|
| CN | 107035321 | A | 8/2017 |
| WO | 2008125108 | A1 | 10/2008 |
| WO | 2010099512 | | 9/2010 |

OTHER PUBLICATIONS

Dictionary definition of "detent", accessed via thefreedictionary.com on Sep. 23, 2022.*

(Continued)

*Primary Examiner* — Blake Michener
(74) *Attorney, Agent, or Firm* — Kilpatrick Townsend & Stockton LLP

(57) ABSTRACT

A drill bit assembly for drilling a hole through earth, the drill bit comprising: a bit body extending between a first end and a second end along a longitudinal axis of the bit body with a connecting arrangement positioned at the first end of the bit body for coupling the bit body to a rotating shaft for providing rotational torque to the bit body; a cutting head including a leading tip portion for cutting into earth and a trailing receiving portion for receiving the second end of the bit body in an internal cavity defined by the receiving portion to allow the cutting head to be removably coupled to the second end of the bit body; a retaining arrangement to retain the second end of the bit body in the receiving portion of the cutting tip.

22 Claims, 4 Drawing Sheets

(51) Int. Cl.

| | |
|---|---|
| ***E21B 10/50*** | (2006.01) |
| ***E21B 10/52*** | (2006.01) |
| ***E21B 10/58*** | (2006.01) |
| ***E21B 10/633*** | (2006.01) |

(58) Field of Classification Search
CPC ..... Y10T 279/1091; B23B 31/1071; E21C 35/191; E21C 35/193; E21C 35/1933; E21C 35/19
See application file for complete search history.

(56) References Cited

U.S. PATENT DOCUMENTS

| | | | | |
|---|---|---|---|---|
| 3,957,307 | A * | 5/1976 | Varda | E21C 35/197 299/106 |
| 4,083,415 | A | 4/1978 | Kita et al. | |
| 4,863,323 | A * | 9/1989 | Glaser | B23B 31/1071 408/239 R |
| 5,127,482 | A | 7/1992 | Rector | |
| 5,173,017 | A * | 12/1992 | Oshnock | B23B 29/046 409/234 |
| 5,624,002 | A | 4/1997 | Huffstutler | |
| 7,225,886 | B1 * | 6/2007 | Hall | E21B 10/62 175/57 |
| 7,537,067 | B1 | 5/2009 | Quisenberry | |
| 7,624,824 | B2 * | 12/2009 | Hall | E21B 10/42 175/389 |
| 8,079,431 | B1 | 12/2011 | Cooley et al. | |
| 9,127,517 | B2 | 9/2015 | Dupal et al. | |
| 11,530,577 | B2 * | 12/2022 | Brooks | E21B 10/633 |
| 2004/0238218 | A1 * | 12/2004 | Runia | E21B 21/10 175/57 |
| 2006/0118298 | A1 | 6/2006 | Millar et al. | |
| 2006/0180354 | A1 * | 8/2006 | Belnap | E21B 10/573 175/426 |
| 2008/0067859 | A1 * | 3/2008 | Hall | E21C 35/19 299/102 |
| 2008/0115978 | A1 * | 5/2008 | Hall | E21C 35/19 299/113 |
| 2010/0108391 | A1 | 5/2010 | Runia | |
| 2011/0101629 | A1 | 5/2011 | Wienhold | |
| 2012/0273281 | A1 | 11/2012 | Burhan et al. | |
| 2015/0060149 | A1 | 3/2015 | Herman et al. | |
| 2015/0322727 | A1 | 11/2015 | Do et al. | |
| 2016/0084010 | A1 * | 3/2016 | Beaton | E21B 10/22 175/432 |

OTHER PUBLICATIONS

Australian Application No. AU2020203254 , "First Examination Report", Mar. 5, 2021, 4 pages.
International Application No. PCT/AU2019/051292 , International Preliminary Report on Patentability, Mailed on Jul. 2, 2020, 9 pages.
International Application No. PCT/AU2019/051292 , International Search Report and Written Opinion, Mailed on Mar. 16, 2020, 12 pages.
International Application No. PCT/US2020/034308 , International Search Report and Written Opinion, Mailed on Aug. 6, 2020, 12 pages.
European Application No. EP19889419.8, "Extended European Search Report", Jun. 29, 2022, 7 pages.
International Application No. PCT/US2020/034308, "International Preliminary Report on Patentability", Jun. 9, 2022, 8 pages.
U.S. Appl. No. 16/881,527, "Notice of Allowance", Aug. 23, 2022, 10 pages.
U.S. Appl. No. 16/881,527, Non-Final Office Action, Mailed on Oct. 1, 2021, 10 pages.
U.S. Appl. No. 16/881,527, Final Office Action, Mailed on Jan. 27, 2022, 9 pages.
Australia AU2020203254, "Subsequent Examination Report", Feb. 3, 2022, 3 pages.
Australian No. AU2022201539 , "First Examination Report", mailed May 17, 2023, 4 pages.
Australian Application No. AU2022201539 , "Second Examination Report", mailed Sep. 13, 2023, 3 pages.
Australian Application No. AU2019387712, "First Examination Report", mailed Nov. 19, 2024, 4 pages.

* cited by examiner

DRILL BIT FOR BORING EARTH AND OTHER HARD MATERIALS

CROSS-REFERENCE TO RELATED APPLICATIONS

This application is a U.S. National Stage of International Application No. PCT/AU2019/051292, filed Nov. 26, 2019, which claims priority to Australian Application No. 2018904497, filed Nov. 26, 2018, which are hereby incorporated by reference in their entireties for all purposes.

TECHNICAL FIELD

The present invention relates to drill bits used to bore through earth, concrete and other hard materials.

BACKGROUND

Any references to methods, apparatus or documents of the prior art are not to be taken as constituting any evidence or admission that they formed, or form part of the common general knowledge.

Specialized drill bits are used to drill wellbores, boreholes, and other holes in the earth for a variety of purposes, including water wells, oil and gas wells, injection wells, geothermal wells, monitoring wells, holes used in mining, and the like. These drill bits come in two common types: roller cone drill bits and fixed cutter drill bits.

Well bores and other holes in the earth are typically drilled by attaching or connecting a drill bit to a means of rotating the drill bit. The drill bit can be attached directly to a shaft that is rotated by a motor, engine, drive, or other means of providing torque to rotate the drill bit. In oil and gas drilling, for example, the drill bit is typically connected to the lower end of a drill string that is in turn, connected at the upper end to a motor or drive at the surface, with the motor or drive rotating both the drill string and the drill bit together. The drill string typically comprises several elements that may include a special down-hole motor configured to provide additional or, if a surface motor or drive is not provided, the only means of turning the drill bit.

Fixed cutter drill bits typically include a plurality of cutters, such as very durable polycrystalline diamond compact (PDC) cutters, tungsten carbide cutters, natural or synthetic diamond, or combinations thereof. These bits are referred to as fixed cutter bits because they employ cutting elements positioned on one or more fixed blades in selected locations or randomly distributed. Fixed cutter bits slide against the formation to remove the rock through a shearing operation. Through varying improvements, the durability of fixed cutter bits has improved sufficiently to make them cost effective in terms of time saved during the drilling process when compared to the higher up-front cost to manufacture the fixed cutter bits.

There exists a need for a cost-effective and robust drill bit that can better drill through a variety of natural and/or man-made formations or objects, including earth, steel, aluminium, concrete, cast iron, and other hard materials. It is also desirable to provide a drill bit that is readily serviceable.

SUMMARY OF INVENTION

In one aspect, the invention provides a drill bit assembly for drilling a hole through earth, the drill bit comprising:

a bit body extending between a first end and a second end along a longitudinal axis of the bit body with a connecting arrangement positioned at the first end of the bit body for coupling the bit body to a rotating shaft for providing rotational torque to the bit body;

a cutting head including a leading tip portion for cutting into earth and a trailing receiving portion for receiving the second end of the bit body in an internal cavity defined by the receiving portion to allow the cutting head to be removably coupled to the second end of the bit body; and a retaining arrangement to retain the second end of the bit body in the receiving portion of the cutting head.

In an embodiment, the bit body comprises a stop member positioned along an outer wall of the bit body to limit axial movement of the receiving portion of the cutting head towards the first end of the bit body thereby engaging the retaining arrangement. In an embodiment, the stop member may be profiled to form a circumferential stop member to engage with the receiving portion of the cutting ahead and limit axial movement.

In an embodiment, the connecting arrangement comprises helical threads provided along an outer wall portion at or adjacent the first end of the bit body to couple the bit body to a rotating shaft for providing rotational torque to the bit body.

In an embodiment, the tip portion of the cutting head comprises a polycrystalline diamond compact (PDC) material.

In an embodiment, the bit body further comprises a bore extending from the first end to the second end along the longitudinal axis of the bit body, the bore being provided to convey a lubricant to the second end of the bit body.

In an embodiment, the second end of the bit body includes a lubricant releasing arrangement to release the lubricant into an internal cavity of the cutting tip thereby lubricating the bearing surfaces of the second end of the bit body and internal bearing surfaces of the cutting tip.

In an embodiment, the drill bit assembly further comprises: a filling lubricant nipple positioned at the first end of the bit body; and a release nipple positioned at the second end of the bit body.

In an embodiment, the retaining arrangement further comprises a split ring member, wherein an inner portion of the split ring member is adapted to be positioned and engaged in a groove provided along an outer wall of the bit body and an outer portion of the split ring is adapted to engage an inner groove provided along an inner wall of the receiving portion of the cutting head.

In an embodiment, the split ring comprises first and second circumferential end points that do not connect.

The cutting head may be push fitted into the bit body by effecting relative axial movement between the cutting head and the bit body such that the receiving portion of the cutting head received the second end of the bit body and the axial movement results in the inner groove of the cutting head being positioned in engagement with the split ring thereby resulting in the second end of the bit body being retained in the receiving portion of the cutting head.

In an alternative embodiment, the retaining arrangement comprises a detent assembly for detachably interlocking the cutting head and the bit body.

In an embodiment, the detent assembly comprises:

a detent groove positioned along an inner wall of the receiving portion that defines the internal cavity for receiving the second end of the bit body;

a detent provided at or adjacent the second end of the bit body along an outer wall of the bit body;

wherein axial movement of the receiving portion of the cutting head towards the first end of the bit body results in engagement and retention of the detent within the detent groove.

In an embodiment, the bit body comprises a hollow passage for receiving a spring loaded pin member that forms part of the retaining arrangement.

In an embodiment, the pin member is biased by a spring member for movement towards the first end of the bit body.

In an embodiment, the drill bit assembly further comprises a cap member to retain the pin member within the hollow passage of the bit body and limit movement of the pin member in a direction towards the first end of the bit body.

In an embodiment, the pin member comprises:

a head portion adapted to be positioned adjacent the first end of the bit body;

a tail portion adapted to be positioned adjacent the second end of the bit body; and a pin body portion extending between the head and tail portions of the pin member.

In an embodiment, the tail portion is narrower than the pin body portion to accommodate a resilient member (such as helical spring) in between outer walls of said tail portion of the pin member and inner walls of the bit body defining said hollow cavity.

In an embodiment, the resilient member urges against a shoulder of the pin body portion to apply said resilient bias on the pin member.

In an embodiment, the hollow cavity of the bit body comprises a narrower throat portion extending towards the second end and wherein axial movement of the pin member towards the second end of the bit body by application of force against the resilient bias of the resilient member results in the cutting head being uncoupled from the bit body by releasing the retaining arrangement.

In an embodiment, the pin member comprises a notch positioned on the pin body such that the axial movement of the pin member towards the second of the bit body results in the notch being axially displaced and become positioned adjacent said detent assembly thereby allowing said detent to be received into the notch and be released from the detent hole of the cutting body.

In an embodiment, the cutting head is movably mounted relative to the bit body. Preferably, the cutting head is rotatably mounted relative to the bit body.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
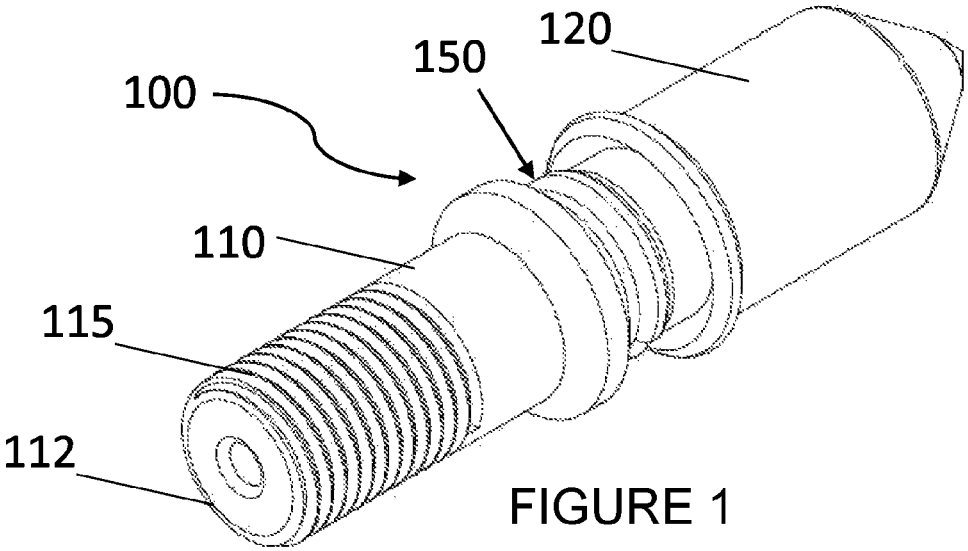
FIG. 1 is a perspective view of a drill bit assembly 100 in accordance with a first embodiment shown in a coupled configuration.
Figure 2:
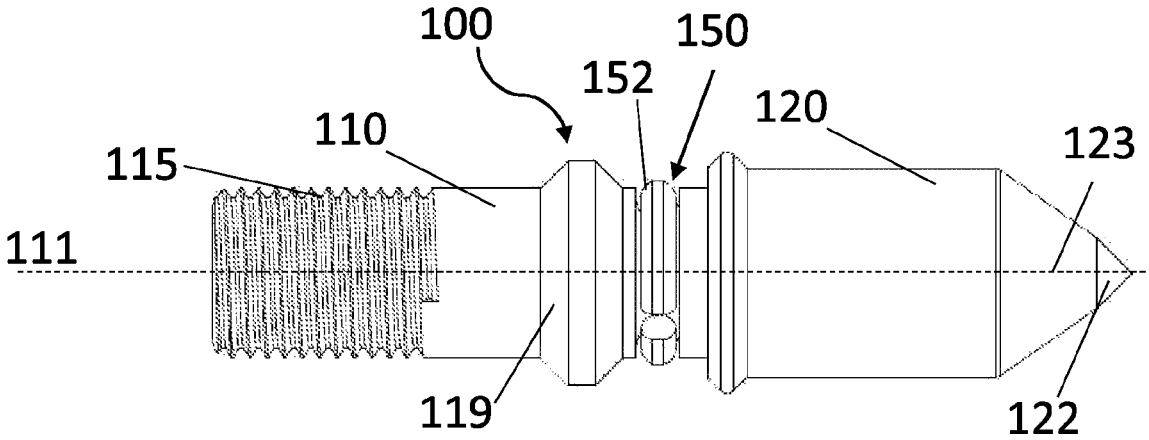
FIG. 2 is a side view of the drill bit assembly 100 in a coupled configuration.
Figure 3:
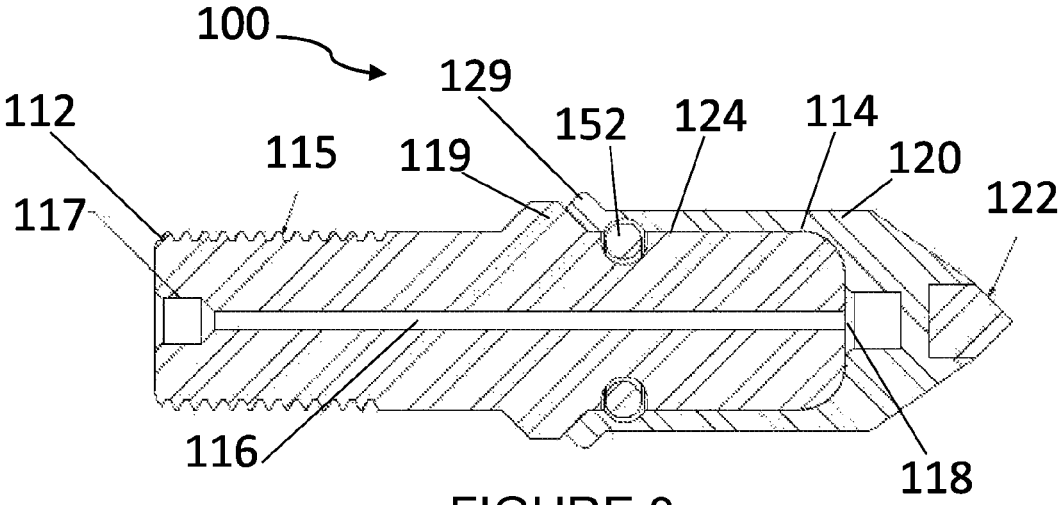
FIG. 3 is a sectional view of the drill bit assembly 100 in a coupled configuration.
Figure 4:
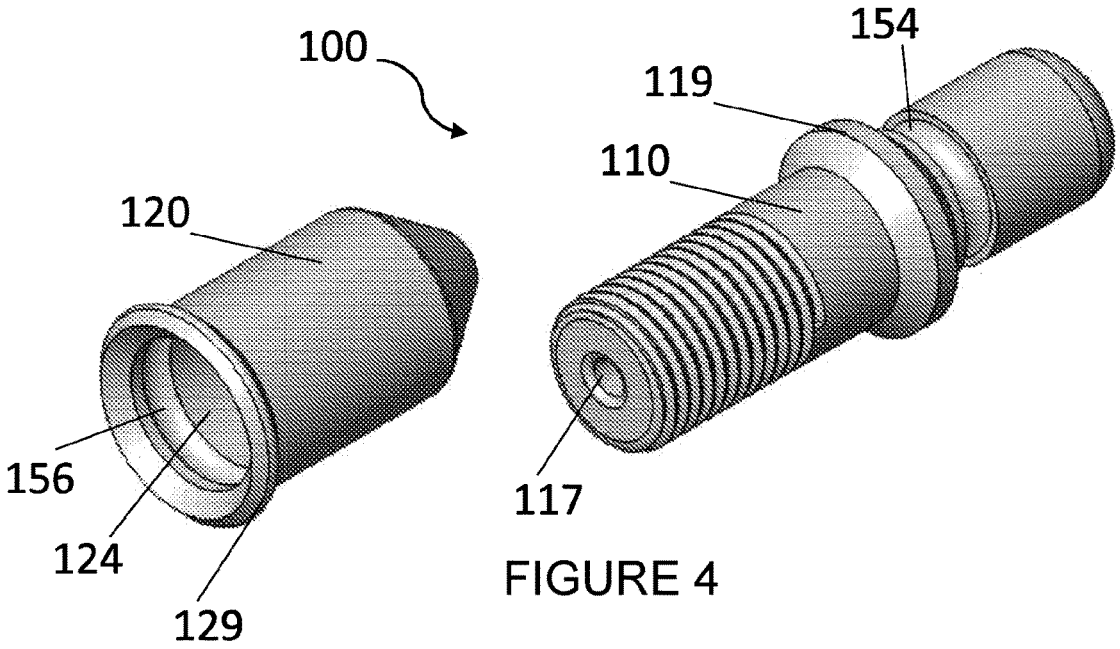
FIG. 4 is an exploded perspective view of the drill bit assembly 100 in an uncoupled configuration.
Figure 5:
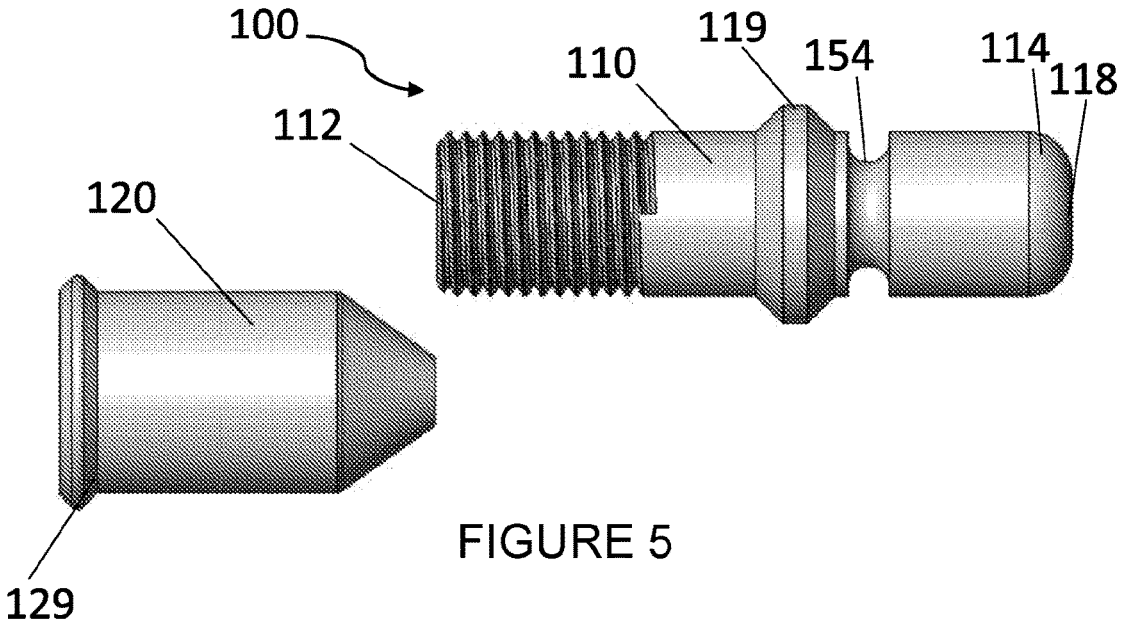
FIG. 5 is an exploded side view of the drill bit assembly 100 in an uncoupled configuration.
Figure 6:
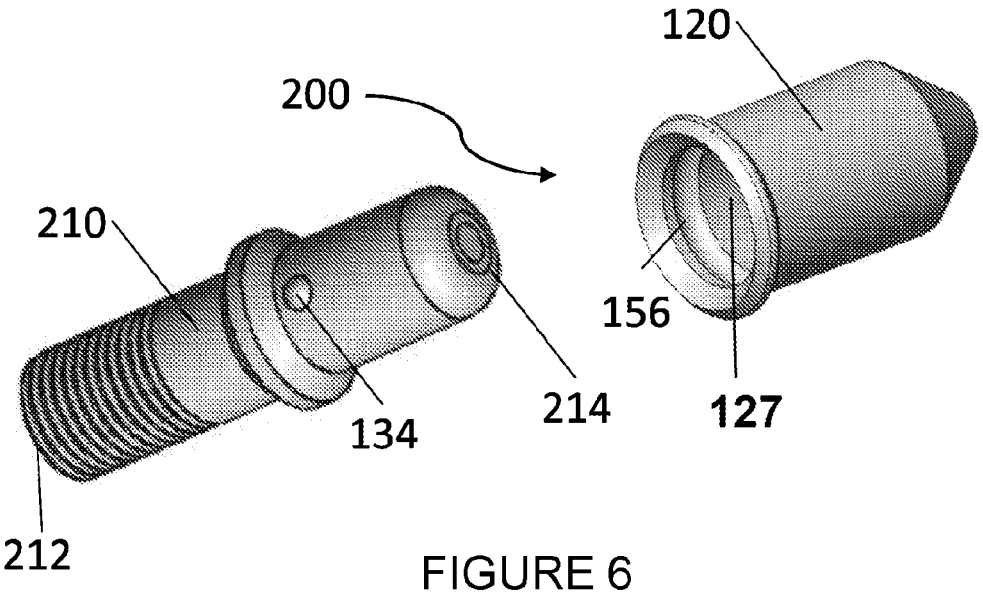
FIG. 6 is an exploded perspective view of a drill bit assembly 200 in accordance with a second embodiment in an uncoupled configuration.
Figure 7:
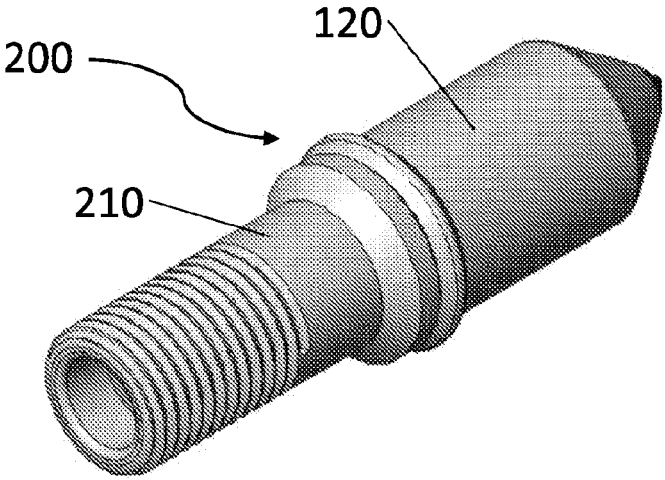
FIG. 7 is a perspective view of a drill bit assembly 200 shown in a coupled configuration.

Embodiments of the drill bit assemblies 100 or 200, as described in the following passages, provide significant advantages and benefits over other devices and methods for boring through earth, concrete and other hard materials. However, the recited advantages are not meant to be limiting in any way, as one skilled in the art will appreciate that other advantages may also be realized upon practicing the invention.

FIGS. 1 to 5 illustrate a drill bit assembly 100 in accordance with a first embodiment of the present invention and include a bit body 110 extending between a first end 112 and a second end 114 along a longitudinal axis 111 of the bit body 110. At the first end 112, helical threads 115 are provided for allowing the body 110 to be coupled to a rotating shaft (not shown) that is coupled to a rotation means for providing rotary torque or force to the drill bit assembly 100, such as a topside motor, a downhole motor, an engine, turbine, or other type of drive that also located near the surface, or some other rotation means.

The second end 114 of the bit body 110 is removably coupled to a cutting head 120 that includes a leading cutting tip 123 comprised of polycrystalline diamond material that is provided in the form of a PDC insert 122 positioned in an exposed portion of the cutting tip 123 to assist with cutting into earth or other hard materials. While the cutting tip 122 in the example drill bit assembly 100 of FIGS. 1 to 5 is a PDC insert, it should be clearly understood that other types of cutting elements such as cubic boron nitride, or other super hard material, or hard material such as a metal carbide, may also be used in a bit made according to the invention. The cutting head 120 comprises a substantially frusto-conical configuration with the PDC tip forming an apex portion of the tip in the cutting head 120.

The cutting head 120 also includes a trailing receiving portion 124 for receiving the second end 114 of the bit body 110 into an internal cavity 126 defined by the receiving portion 124 to allow the cutting head 120 to be removably coupled to the second end 114 of the bit body 110.

A retaining arrangement 150 is provided to retain the second end 114 of the bit body 110 in the receiving portion 124 of the cutting head 120. Detailed views of the retaining arrangement have been shown in FIGS. 3, 4 and 5 which clearly illustrate that the retaining arrangement 150 comprises a split ring member 152 wherein an inner portion of the split ring member 152 is adapted to be positioned and engaged in an outer groove 154 (See FIGS. 4 and 5) provided along an outer wall of the bit body 110 and an outer portion of the split ring 152 is adapted to engage an inner groove 156 (See FIGS. 4 and 5) provided along an inner wall of the receiving portion 124 of the cutting head 120. The split ring 152 is in the form of a ring shaped member with first and second circumferential end points that do not connect and the circumference of the split ring member is slightly lesser than the circumference of the outer groove 154 of the bit body 110.

The provision of the split ring 152 allows for the cutting head 120 to be push fitted onto the bit body 110 by effecting relative axial movement between the cutting head 120 and the bit body 110 such that the receiving portion 124 of the cutting head 120 receives the second end 114 of the bit body 110 and the axial movement results in the inner groove 156 of the cutting head 120 being positioned in engagement with the split ring 152 by pushing onto the split ring 152 causing the circumferential ends of the split ring 152 to move closer and snap onto the outer groove 154 of the bit body 110. This action results in the second end 114 of the bit body 110 being retained in the receiving portion 124 of the cutting head 120.

The configuration of the spit ring 152 and the positioning of the outer groove of the bit body 154 and the inner groove 156 of the cutting head 120 allows the cutting head 120 to freely rotate relative to the bit body 110. The split ring 152 therefore provides a bearing arrangement to enable relative rotational movement between the bit body 110 and the cutting head 120.

The cutting head 120 also includes a profiled stop member 129 that is positioned along an outer wall of the bit body 110 to limit axial movement of the receiving portion 124 of the cutting head 120 towards the first end 112 of the bit body 110. In order to assemble the drill bit assembly 100, an operator would be required to effect axial movement of the cutting head 120 towards the bit body 110 in order to align the inner groove 156 of the cutting head 120 with the outer groove 154 thereby resulting in applying a pushing force onto the split ring 152 which results in the cutting head 120 being snap fitted onto the receiving portion 124 of the bit body 110. Such axial movement of the cutting head 120 results in the profiled stop member 129 on the cutting head 120 abutting the circumferential collar member 119 provided along an outer wall of the bit body 110 thereby limiting the extent of relative axial movement between the cutting head 120 and the bit body 110 when the second end 114 of the bit body 110 is received into the internal cavity of the receiving portion 124 of the cutting head 124. The aforementioned arrangement allows the cutting head 120 to be uncoupled from the bit body 110 by application of a pulling force on the cutting head 120 to pull the cutting head 120 in an axial direction away from the first end 112 of the bit body 110.

The bit body 110 also includes a bore 116 extending from the first end 112 to the second end 114 along the longitudinal axis of the bit body 110. The bore 116 is provided to convey a lubricant from the first end 112 to the second end 114 of the bit body 110. A filling lubricant nipple 117 is positioned at the first end 112 of the bit body 110 and a release nipple 118 is positioned at the second end 114 of the bit body 110. The release nipple 118 is arranged to release the lubricant into an internal cavity 121 of the cutting tip thereby lubricating the bearing surfaces 125 of the second end 114 of the bit body 110 and internal bearing surfaces of the cutting tip 120.

Referring to FIGS. 6 to 9, a drill bit assembly 200 in accordance with a second embodiment of the present invention has been illustrated. Like reference numerals denote like features that have been previously described in the earlier sections. The main difference between the drill bit assembly 200 and the previously described drill assembly 100 relates to the configuration of the bit body 210 which is different from the bit body 110 described in the earlier sections. Furthermore, a release pin 250 that is housed within the bit body 210 provides a mechanical arrangement to allow the cutting head 120 to be released from a bit body 210 as will be described in the foregoing sections.

The bit body 210 also extends between a first end 212 and a second end 214. The cutting head 120 is detachably coupled or interlocked to the second end 114 of the bit body 210 by way of a detent assembly 130. The detent assembly 130 comprises: a detent groove 156 positioned along an inner wall 127 that defines the internal cavity of the receiving portion 124 for receiving the second end 214 of the bit body 210. A detent ball 134 is provided adjacent the second end 214 of the bit body 210 along an outer wall of the bit body 210. One of the problems addressed by the drill assembly 200 relates to easily replacing the cutting head 120 whilst also reducing maintenance times. Axial movement of the receiving portion 124 of the cutting head 120 towards the first end 212 of the bit body 210 results in engagement of the detent ball 134 with the detent groove 156 thereby catching the detent ball 134 and retaining the cutting head 120 in a coupled configuration with the second end 114 of the bit body 110. Therefore the detent assembly 130 provides a retaining arrangement to retain the second end 114 of the bit body 210 in the receiving portion 124 of the cutting head 120.

The cutting head 120 also includes the profiled stop member 129 that is positioned along an outer wall of the bit body 110 to limit axial movement of the receiving portion 124 of the cutting head 120 towards a first end 212 of the bit body 210. Axial movement of the cutting head 120 results in the profiled stop member 129 abutting a circumferential collar member 219 provided along an outer wall of the bit body 210 thereby limiting the extent of relative axial movement between the cutting head 120 and the bit body 210 when the second end 214 of the bit body 210 is received into the internal cavity of the receiving portion 124 of the cutting head 124.

Figure 8:
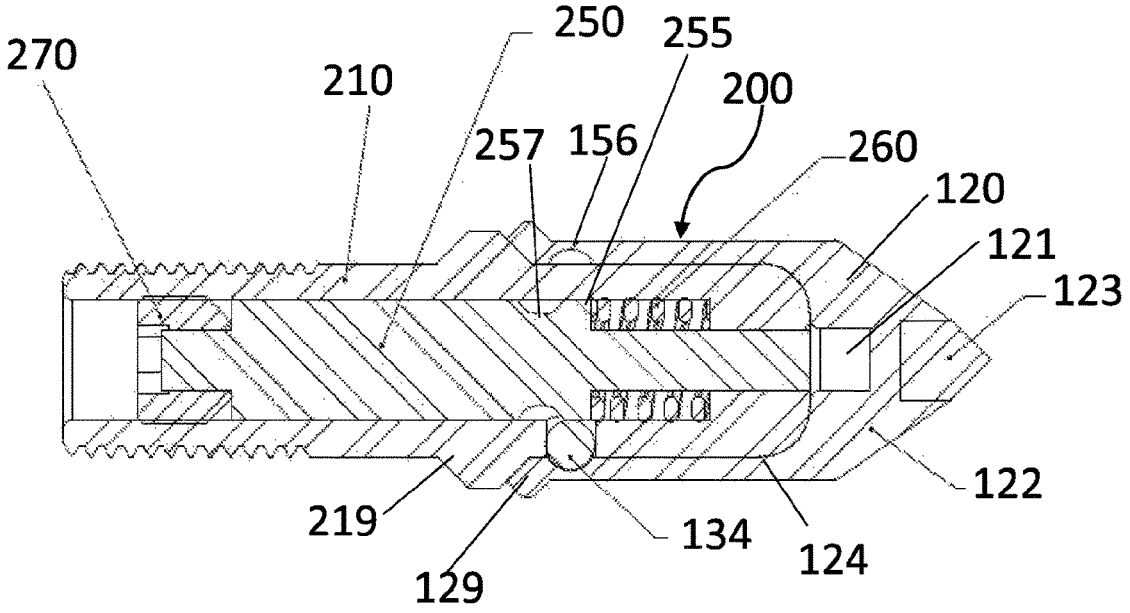
FIG. 8 is a sectional view of the drill bit assembly 200.
Figure 9:
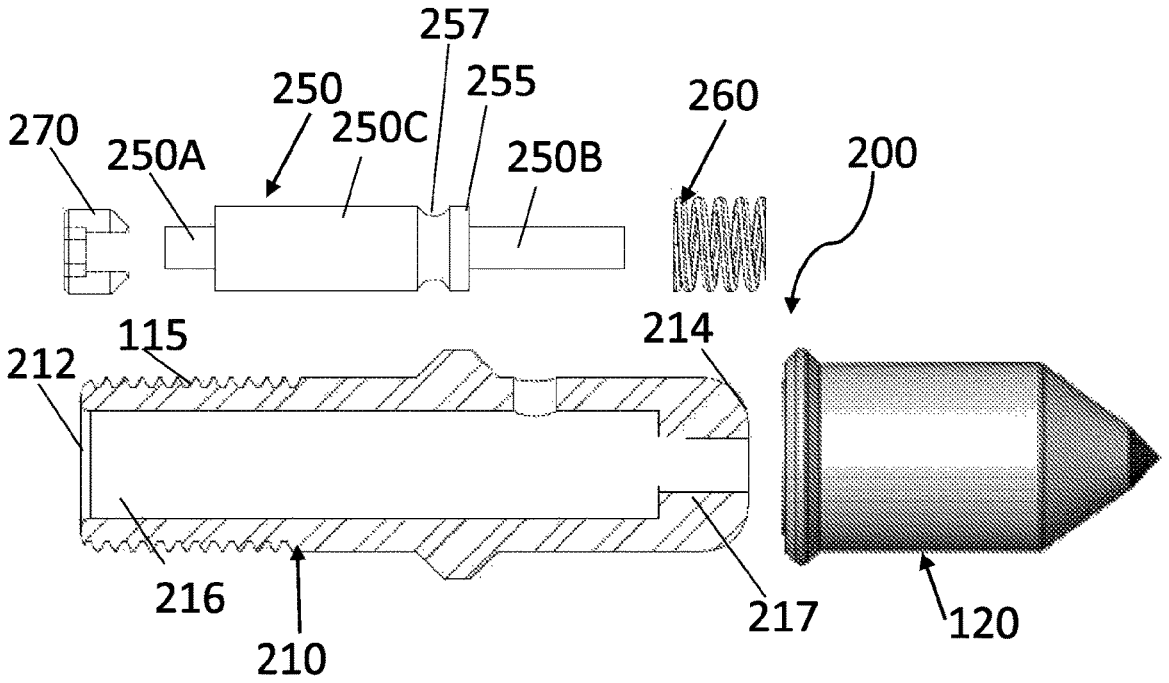
FIG. 9 is an exploded sectional view of the drill bit assembly 200.

Referring to FIGS. 8 and 9, the bit body 210 comprises a hollow passage 216 that extends between the first and second ends 212 and 214. The hollow passage 216 is configured for receiving the spring loaded pin member 250 that allows for the cutting head 120 to be released from the bit body 210. The pin member 250 is biased by a spring member 260 (that urges against the pin member 250 as will be explained in the foregoing sections) for movement towards the first end 212 of the bit body 110. A cap member 270 is provided to retain the release pin member 250 within the hollow passage 216 of the bit body 210 and limit axial movement of the release pin member 250 in a direction towards the first end 212 of the bit body 210.

The configuration of the pin member 250 in combination with the spring member 260 and the shape of the hollow passage 216 enables the cutting head 120 to be mechanically released from the bit body 210 and allows the cutting head 120 to be easily replaced. Referring to FIG. 9, the pin member 250 includes a head portion 250A adapted to be positioned adjacent the first end 212 of the bit body 210; a tail portion 250B adapted to be positioned adjacent the second end 214 of the bit body 210; and a pin body portion 250C extending between the head and tail portions 250A and 250B of the pin member 250. The tail portion 250B is narrower than the pin body portion 250 C and helps accommodate the resilient spring member 260 in between outer walls of said tail portion 250B of the release pin member 250 and inner walls of the bit body 210 defining said hollow cavity/passage 216. In a neutral configuration, the spring member 260 urges against a shoulder portion 255 of the pin body 250C to apply the resilient bias on the pin 250. The hollow passage 216 includes a narrower constricted portion 217 extending towards the second end 214 of the bit body 210.

The aforementioned configuration of the release pin member 250 provides a mechanical arrangement that allows the cutting head 120 to be easily uncoupled from the bit body 210. A cap member in the form of a grub screw 270 is provided to act as a stop for the spring loaded pin member 250 and maintain the cutting head 120 in an inter-locked position with the bit body 210. In order to uncouple the bit body 210 from the cutting head 120, the grub screw 270 needs to be moved axially forward by turning the grub screw (270) in order to push the pin member towards the second end 214 of the bit body 210. The inward pushing of the pin member 250 by turning the grub screw 270 results in the narrower tail portion 250B being inserted into an internal cavity 121 (See FIG. 8). The pin body 250C includes a notch 257 positioned along the outer wall of the pin body 250C such that the axial movement of the pin member 250 towards the second end 214 of the bit body 210 results in the notch 257 being axially displaced and become positioned adjacent the detent assembly 130. Once the notch is aligned with the detent ball 134, an operator may apply a pulling force on the cutting head 120. The pulling of the cutting head 120 causes the walls of the detent groove 156 to push the detent ball 134 into the notch 257 (which is positioned in alignment with the detent ball 134 due to the axial displacement of the release pin member 250-by turning the grub screw 270 as discussed earlier.

Once again, the provision of the detent all 134 in combination with the detent groove 156 also allows the cutting head 120 to freely rotate relative to the bit body 210. The detent arrangement 130 therefore also provides a bearing arrangement to enable relative movement between the bit body 210 and the cutting head 120.

It is important to appreciate that the cutting head 120 comprises a configuration that can be used with the bit body 110 or bit body 210 depending on the drilling requirements of the user.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

The invention claimed is:

1. A removable cutter insert assembly for a boring or excavating tool, the removable cutter insert assembly comprising:

a body extending between a first end and a second end along a longitudinal axis of the body with a connecting arrangement positioned at the first end of the body for coupling the body to a portion of a rotating boring or excavating tool, wherein a diameter of the first end is substantially the same as a diameter of the second end;

a cutting head that is releasably coupled with the body, the cutting head comprising a leading end and a trailing end, wherein:

the leading end defines a recess having at least one sidewall and a bottom surface, the leading end comprising an outer surface that tapers inwardly towards a central axis of the cutting head;

the trailing end comprises a receiving portion for receiving the second end of the body in an internal cavity defined by the receiving portion to allow the cutting head to be releasably coupled to the second end of the body;

the internal cavity and the recess are separated by a wall;

a leading tip portion for cutting into earth is seated within the recess and against the bottom surface of the recess, wherein the leading tip portion comprises a distal outer surface that extends past the leading end and is substantially flush with the outer surface of the leading end;

the leading tip portion is coaxially aligned with longitudinal axes of the body and the cutting head; and a retaining arrangement to retain the second end of the body in the receiving portion of the cutting head.

2. A removable cutter insert assembly for a boring or excavating tool in accordance with claim 1 wherein the body comprises a stop member positioned along an outer wall of the body to limit axial movement of the receiving portion of the cutting head towards the first end of the body.

3. A removable cutter insert assembly for a boring or excavating tool in accordance with claim 1 wherein the connecting arrangement comprises one or more helical threads provided along an outer wall portion at or adjacent the first end of the body to couple the body to the portion of the rotating boring tool.

4. A removable cutter insert assembly for a boring or excavating tool in accordance with claim 1 wherein the tip portion of the cutting head comprises a polycrystalline diamond compact (PDC) material.

5. A removable cutter insert assembly for a boring or excavating tool in accordance with claim 1 further comprising a bore extending from the first end to the second end along the longitudinal axis of the body, the bore being provided to convey a lubricant to the second end of the body.

6. A removable cutter insert assembly for a boring or excavating tool in accordance with claim 5 wherein the second end of the body includes a lubricant releasing arrangement to release the lubricant into the internal cavity of the cutting head thereby lubricating bearing surfaces of the second end of the body and internal surfaces for the cavity of the cutting head.

7. A removable cutter insert assembly for a boring or excavating tool in accordance with claim 1 further comprising: a filling lubricant nipple positioned at the first end of the body; and a release nipple positioned at the second end of the body.

8. A removable cutter insert assembly for a boring or excavating tool in accordance with claim 1 wherein the retaining arrangement further comprises a split ring member, wherein an inner portion of the split ring member is adapted to be seated and engaged in a groove provided along an outer wall located adjacent the second end of the body and wherein an outer portion of the split ring is adapted to engage an inner groove provided along an inner wall of the receiving portion of the cutting head.

9. A removable cutter insert assembly for a boring or excavating tool in accordance with claim 8 wherein the split ring comprises first and second circumferential end points that do not connect.

10. A removable cutter insert assembly for a boring or excavating tool in accordance with claim 8 wherein the cutting head can be push fitted onto the body by effecting relative axial movement between the cutting head and the body such that the receiving portion of the cutting head receives the second end of the body and the axial movement results in the inner groove of the cutting head being positioned in engagement with the split ring thereby resulting in the second end of the body being non-releasably retained in the receiving portion of the cutting head.

11. A removable cutter insert assembly for a boring or excavating tool in accordance with claim 1 wherein the retaining arrangement comprises a detent assembly for detachably interlocking the cutting head and the body.

12. A removable cutter insert assembly for a boring or excavating tool in accordance with claim 11 wherein the detent assembly comprises:

a detent groove positioned along an inner wall of the receiving portion that defines the internal cavity for receiving the second end of the body; and a detent provided at or adjacent the second end of the body along an outer wall of the body;

wherein axial movement of the receiving portion of the cutting head towards the first end of the body results in engagement and retention of the detent within the detent groove.

13. A removable cutter insert assembly for a boring or excavating tool in accordance with claim 1 wherein the body comprises a hollow passage and a spring loaded pin member that forms part of the retaining arrangement is received within the hollow passage.

14. A removable cutter insert assembly for a boring or excavating tool in accordance with claim 13 wherein the spring loaded pin member is biased towards the first end of the body.

15. A removable cutter insert assembly for a boring or excavating tool in accordance with claim 14 further comprising a cap member to retain the pin member within the hollow passage of the body and limit movement of the pin member in a direction towards the first end of the body.

16. A removable cutter insert assembly for a boring or excavating tool in accordance with claim 13 wherein the pin member comprises:

a head portion positioned adjacent the first end of the body;

a tail portion positioned adjacent the second end of the body; and a pin body portion extending between the head and tail portions of the pin member.

17. A removable cutter insert assembly for a boring or excavating tool in accordance with claim 16 wherein the tail portion is narrower than the pin body portion to accommodate the spring of the spring loaded pin member in between outer walls of the tail portion and inner walls defining the hollow passage.

18. A removable cutter insert assembly for a boring or excavating tool in accordance with claim 17 wherein the spring urges against a shoulder of the pin body portion to bias the pin member.

19. A removable cutter insert assembly for a boring or excavating tool in accordance with claim 18 wherein the hollow passage of the body comprises a narrower throat portion extending towards the second end and wherein axial movement of the pin member towards the second end of the body by application of force against the bias of spring results in the cutting head being uncoupled from the body by releasing the retaining arrangement.

20. A removable cutter insert assembly for a boring or excavating tool in accordance with claim 19 wherein the retaining arrangement comprises a detent assembly comprising:

a detent groove positioned along an inner wall of the receiving portion that defines the internal cavity for receiving the second end of the body; and a detent provided at or adjacent the second end of the body along an outer wall of the body; and the pin member comprises a notch positioned on the pin body portion such that during use, the axial movement of the pin member towards the second end of the body results in the notch being axially displaced and becoming positioned adjacent the detent assembly thereby allowing said detent to be received into the notch and be released from the detent groove of the cutting head.

21. A removable cutter insert assembly for a boring or excavating tool in accordance with claim 1 wherein the cutting head is movably mounted relative to the body.

22. A removable cutter insert assembly for a boring or excavating tool in accordance with claim 1 wherein the cutting head is rotatably mounted relative to the body.

* * * * *